US011389985B2

(12) United States Patent
Béliveau et al.

(10) Patent No.: US 11,389,985 B2
(45) Date of Patent: Jul. 19, 2022

(54) FRY CUTTER AND CUBER

(71) Applicant: LES PROMOTIONS ATLANTIQUES INC., Longueuil (CA)

(72) Inventors: Stéphane Béliveau, Longueuil (CA); Eric Korn, St-Lambert (CA)

(73) Assignee: LES PROMOTIONS ATLANTIQUES INC., Longueuil (CA)

( * ) Notice: Subject to any disclaimer, the term of this patent is extended or adjusted under 35 U.S.C. 154(b) by 15 days.

(21) Appl. No.: 16/806,648

(22) Filed: Mar. 2, 2020

(65) Prior Publication Data

US 2020/0338777 A1 Oct. 29, 2020

Related U.S. Application Data

(60) Provisional application No. 62/812,608, filed on Mar. 1, 2019.

(51) Int. Cl.

| | |
|---|---|
| ***B26D 7/26*** | (2006.01) |
| ***B26D 7/06*** | (2006.01) |
| ***B26D 3/18*** | (2006.01) |
| ***B26D 1/03*** | (2006.01) |

(52) U.S. Cl.

CPC ..... *B26D 7/2614* (2013.01); *B26D 1/03* (2013.01); *B26D 3/185* (2013.01); *B26D 7/0608* (2013.01); *B26D 2210/02* (2013.01)

(58) Field of Classification Search

CPC ..... B26D 7/2614; B26D 1/03; B26D 3/18; B26D 3/185; B26D 7/0608; B26D 3/26; B26D 2210/02; Y10S 83/932

USPC ..... 83/932

See application file for complete search history.

(56) References Cited

U.S. PATENT DOCUMENTS

| | | | | | |
|---|---|---|---|---|---|
| 792,396 | A | * | 6/1905 | Buell | B26D 3/185 |
| 810,998 | A | * | 1/1906 | Thomas | B26D 3/18 |
| 1,477,421 | A | * | 12/1923 | Brooks | B26D 3/185 83/408 |
| 2,303,595 | A | * | 12/1942 | Young | B26D 3/185 83/404.2 |

(Continued)

FOREIGN PATENT DOCUMENTS

| | | |
|---|---|---|
| CA | 47720 S | 12/1980 |
| CA | 48423 S | 7/1981 |

(Continued)

*Primary Examiner* — Evan H MacFarlane

(74) *Attorney, Agent, or Firm* — Merchant & Gould P.C.

(57) ABSTRACT

A cutting device for cutting an edible product into several pieces, the cutting device including a base frame, a main receiving area, a main pushing assembly, and a main cutting assembly, for receiving and cutting the edible product into a series of main cuts, via an array of holes, provided by a main cutting interface. The cutting device further includes a preliminary cutting assembly removably mountable about the base frame for first receiving and cutting the edible product into a series of preliminary cuts, via an array of holes provided by a preliminary cutting interface, prior to insertion of the edible product into the main receiving area, wherein the edible product is ultimately cut into a series of pieces resulting from the passage through at least one, and/or both, of the main and preliminary cutting interfaces of the cutting device.

14 Claims, 7 Drawing Sheets

(56) References Cited

U.S. PATENT DOCUMENTS

| | | | | | |
|---|---|---|---|---|---|
| 2,353,607 | A * | 7/1944 | Young | B26D 3/185 | 83/404.2 |
| 2,661,039 | A * | 12/1953 | Davis | B26D 3/185 | 99/513 |
| 3,115,172 | A * | 12/1963 | Meurer Von Inffeld | B26D 3/20 | 83/144 |
| 3,217,768 | A * | 11/1965 | Lamb | B26D 3/185 | 83/404.2 |
| 3,273,617 | A * | 9/1966 | Lamb | B26D 1/553 | 83/90 |
| RE26,796 | E * | 2/1970 | Lamb | B26D 3/185 | |
| D274,888 | S | 7/1984 | Lang | | |
| D277,732 | S | 2/1985 | Lang | | |
| D342,932 | S | 1/1994 | Primeau | | |
| 5,367,932 | A * | 11/1994 | Bergman | A01F 29/005 | 83/425.2 |
| 5,482,759 | A | 1/1996 | Primeau | | |
| D399,705 | S | 10/1998 | Bovard et al. | | |
| 5,957,045 | A | 9/1999 | He et al. | | |
| D414,661 | S | 10/1999 | Tardif | | |
| 5,979,281 | A * | 11/1999 | Caesar | B26D 1/09 | 30/305 |
| D418,020 | S | 12/1999 | Tardif | | |
| D422,173 | S | 4/2000 | He et al. | | |
| D441,198 | S | 5/2001 | Primeau | | |
| D499,057 | S | 11/2004 | Lafleur | | |
| D543,070 | S | 5/2007 | Tardif | | |
| 7,587,968 | B1 * | 9/2009 | Roberts | B26D 3/185 | 83/404.3 |
| D696,059 | S | 12/2013 | Bourbeau | | |
| 8,640,587 | B2 * | 2/2014 | Cheung | B26D 3/185 | 83/435.19 |
| D734,090 | S | 7/2015 | Bourbeau | | |
| 9,302,403 | B2 * | 4/2016 | Neare-Vaarmann | B26D 7/1818 | |
| 10,759,071 | B2 * | 9/2020 | Chan | B26D 7/01 | |
| 2004/0067337 | A1 | 4/2004 | Lafleur | | |
| 2006/0032007 | A1 | 2/2006 | Lafleur | | |
| 2011/0197452 | A1 * | 8/2011 | So | A47J 36/34 | 30/123 |
| 2014/0216226 | A1 * | 8/2014 | Homsi | B26D 1/03 | 83/167 |
| 2014/0220170 | A1 | 8/2014 | Bourbeau | | |
| 2015/0367481 | A1 | 12/2015 | Feng et al. | | |
| 2016/0255993 | A1 | 9/2016 | Feng et al. | | |

FOREIGN PATENT DOCUMENTS

| | | | |
|---|---|---|---|
| CA | 49876 | S | 6/1982 |
| CA | 50718 | S | 1/1983 |
| CA | 51163 | S | 4/1983 |
| CA | 74579 | S | 8/1984 |
| CA | 1 223 481 | A1 | 6/1987 |
| CA | 65048 | S | 1/1990 |
| CA | 65826 | S | 4/1990 |
| CA | 68715 | S | 6/1991 |
| CA | 70694 | S | 5/1992 |
| CA | 726905 | S | 6/1993 |
| CA | 72811 | S | 7/1993 |
| CA | 73211 | S | 9/1993 |
| CA | 73553 | S | 12/1993 |
| CA | 2 089 030 | A1 | 8/1994 |
| CA | 2 138 758 | A1 | 6/1996 |
| CA | 81378 | S | 8/1997 |
| CA | 82229 | S | 10/1997 |
| CA | 82230 | S | 10/1997 |
| CA | 2 054 042 | C | 1/1999 |
| CA | 85835 | S | 2/1999 |
| CA | 87017 | S | 6/1999 |
| CA | 87103 | S | 7/1999 |
| CA | 2 212 112 | A1 | 12/1999 |
| CA | 2 310 180 | A1 | 11/2001 |
| CA | 2 314 537 | A1 | 1/2002 |
| CA | 2 404 566 | A1 | 3/2004 |
| CA | 2 415 879 | A1 | 7/2004 |
| CA | 2 416 495 | A1 | 7/2004 |
| CA | 2 114 992 | C | 11/2004 |
| CA | 2 477 477 | A1 | 2/2006 |
| CA | 2 625 181 | A1 | 5/2007 |
| CA | 2 656 662 | A1 | 9/2010 |
| CA | 140222 | S | 12/2011 |
| CA | 142534 | S | 12/2011 |
| CA | 142535 | S | 12/2011 |
| CA | 142536 | S | 12/2011 |
| CA | 142537 | S | 12/2011 |
| CA | 2 749 842 | A1 | 2/2013 |
| CA | 149605 | S | 2/2014 |
| CA | 2 806 225 | A1 | 8/2014 |
| CA | 2 855 060 | A1 | 9/2015 |
| CA | 161408 | S | 10/2015 |
| CA | 2 884 520 | A1 | 9/2016 |
| CA | 168993 | S | 1/2017 |
| GB | 2346544 | * | 2/1992 |
| GB | 2246510 | * | 8/2020 |

* cited by examiner

FRY CUTTER AND CUBER

This application claims benefit of U.S. Patent Application Ser. No. 62/812,608, filed 1 Mar. 2019 and which application is incorporated herein by reference. To the extent appropriate, a claim of priority is made to the above disclosed application.

FIELD OF THE INVENTION

The present invention relates to the field of household products used for cutting and/or cubing edible products, such as vegetables (ex. potatoes, etc.) and the like. More particularly, the present invention relates to a cutting device for cutting an edible product into corresponding pieces, and also relates to a kit with corresponding components for assembling the same, and to corresponding methods of manufacturing, assembling and/or operating associated thereto.

BACKGROUND

Household products used for cutting and/or cubing edible products, such as vegetables (ex. potatoes, etc.) and the like, are well known in the art.

Over the years, the Assignee of the present application has developed a series of innovative household products, as well as products relating to other fields, examples of which are described in the following US patents, patent applications and/or industrial designs: U.S. Pat. Nos. 5,482,759; 5,957,045; 2004/0067337 A1; 2006/0032007 A1; 2014/0220170 A1; 2015/0367481 A1; 2016/0255993 A1; D274,888; D277,732; D342,932; D399,705; D414,661; D418,020; D422,173; D441,198 S; D499,057 S; D543,070 S; D696,059 S; and D734,090 S.

Examples of these products developed by the Assignee are also described in the following Canadian patent and/or patent applications: 1,223,481; 2,054,042; 2,089,030; 2,114,992; 2,138,758; 2,212,112; 2,310,180; 2,314,537; 2,404,566; 2,415,879; 2,416,495; 2,477,477; 2,625,181; 2,656,662; 2,749,842; 2,806,225; 2,855,060; and 2,884,520.

Further examples of these products developed by the Assignee are also described and illustrated in the following Canadian industrial designs: 47720; 48423; 49876; 50718; 51163; 65048; 65826; 68715; 70694; 72690; 72811; 73211; 73553; 74579; 81378; 82229; 82230; 85835; 87017; 87103; 142537; 142535; 142536; 142534; 140222; 149605; 161408; and 168993.

Despite these various improvements over the years, there is always a need to continue innovating and finding better and/or different ways of cutting and/or cubing edible products, such as vegetables (ex. potatoes, etc.) and the like, for example.

Indeed, it would be particularly advantageous to provide a cutting device being capable of cutting and/or cubing edible products in a more efficient, more precise, more accurate, more reliable, more adjustable, more versatile, more adaptable, more ergonomic and/or more desirable manner.

Thus, it would be particularly useful to be able to provide an improved cutting device which would be able to overcome or at the very least minimize some of known drawbacks associated with conventional cutting devices, for example.

SUMMARY OF THE INVENTION

An object of the present invention is to provide a cutting device which, by virtue of its design and components, would be an improvement over other related conventional cutting devices and/or methods known in the prior art.

In accordance with the present invention, the above object is achieved, as will be easily understood from the present description, with a cutting device (also referred to herein simply as "cutter" and/or "cuber") such as the one briefly described herein and such as the one exemplified in the accompanying drawings.

More particularly, according to one aspect of the present invention, an object is to provide a cutting device for cutting an edible product into a plurality of pieces, the cutting device comprising:

a base frame;

a main receiving area disposed about the base frame for receiving therein the edible product to be cut;

a main pushing assembly being positioned, shaped and sized about the base frame for selectively pushing the edible product to be cut along a given travel distance within the main receiving area, via a manual operation of the main pushing assembly;

a main cutting assembly disposed about the base frame, opposite to the main pushing assembly, for receiving and cutting the edible product pushed by the main pushing assembly, into a series of main cuts, via an array of holes provided by a main cutting interface of the main cutting assembly;

a preliminary cutting assembly removably mountable about the base frame for first receiving and cutting the edible product into a series of preliminary cuts, via an array of holes provided by a preliminary cutting interface of the preliminary cutting assembly, prior to insertion of the edible product into the main receiving area, wherein the edible product is ultimately cut into a series of pieces resulting from the passage of the edible product through at least one (and/or both) of said main and preliminary cutting interfaces of the two different cutting assemblies of the cutting device.

According to yet another aspect of the invention, there is also provided a method of manufacturing components of the above-mentioned cutting device.

According to yet another aspect of the invention, there is also provided a method of assembling components of the above-mentioned cutting device.

According to yet another aspect of the invention, there is also provided a method of using the above-mentioned cutting device and/or component(s) thereof.

According to yet another aspect of the invention, there is also provided a kit with components for assembling the above-mentioned cutting device.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of doing business with the above-mentioned cutting device, component(s) thereof, kit, set and/or method(s).

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 2:
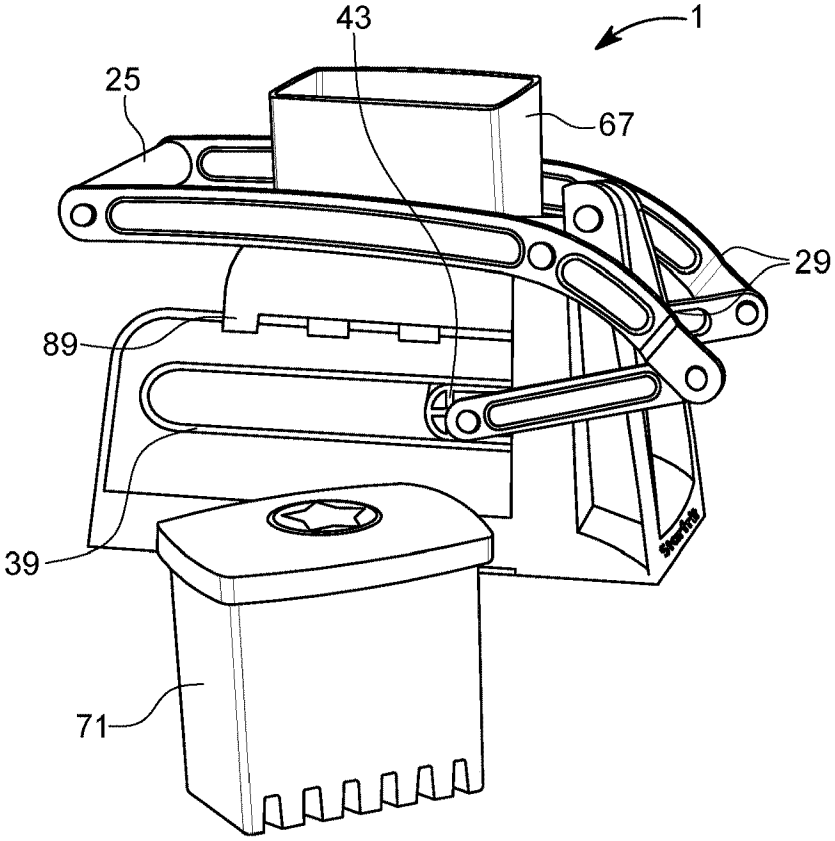
FIG. 2 is a side perspective view of what is shown in FIG. 1, the pushing component of the preliminary cutting assembly being shown removed from the upper housing component.
Figure 1:
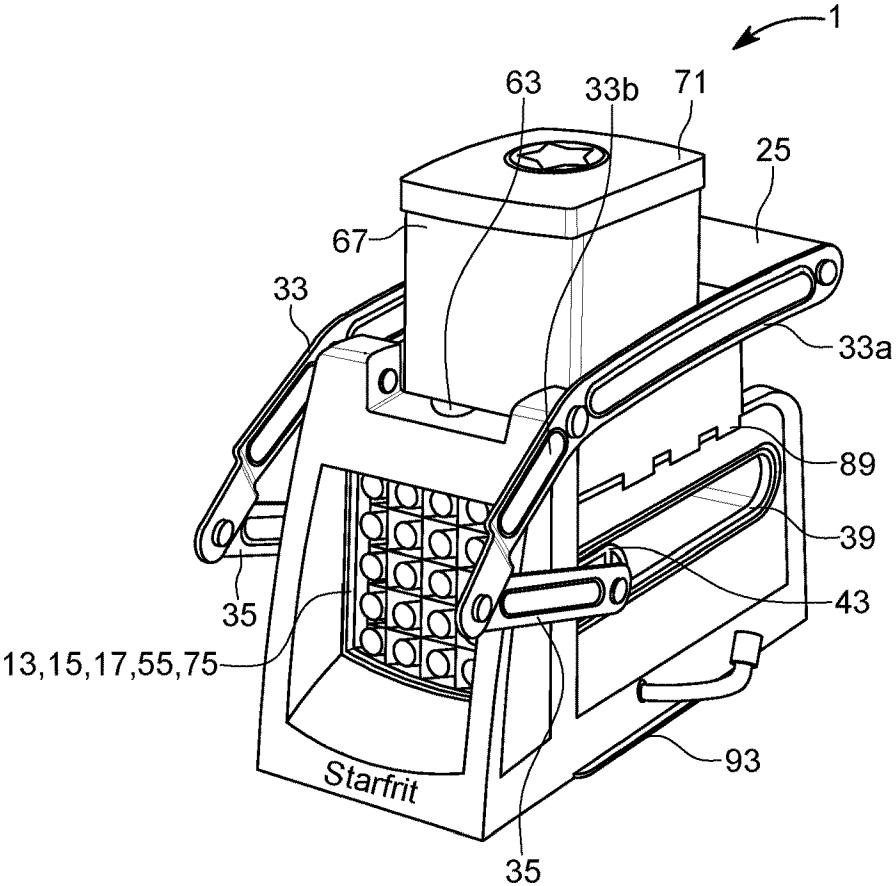
FIG. 1 is a front perspective view of a cutting device according to a possible embodiment of the present invention.
Figure 3:
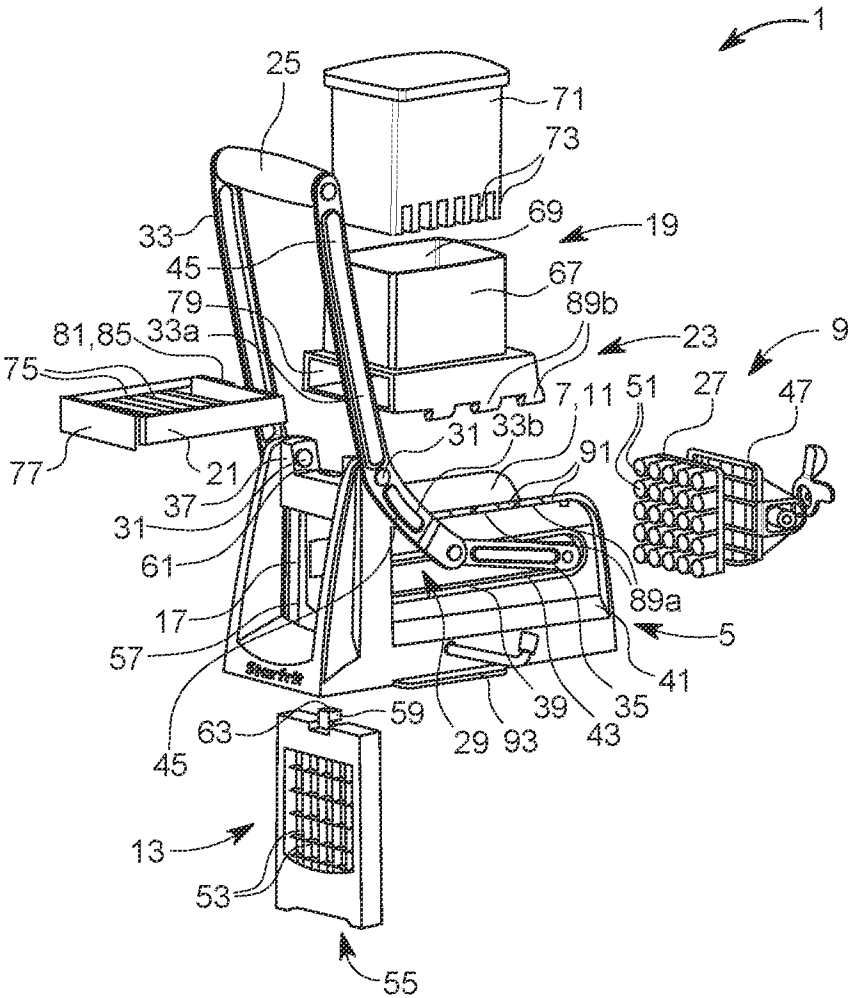
FIG. 3 is an exploded perspective view of the cutting device shown in FIG. 1 so as to better illustrate the different components thereof according to a possible embodiment of the present invention.
Figure 5:
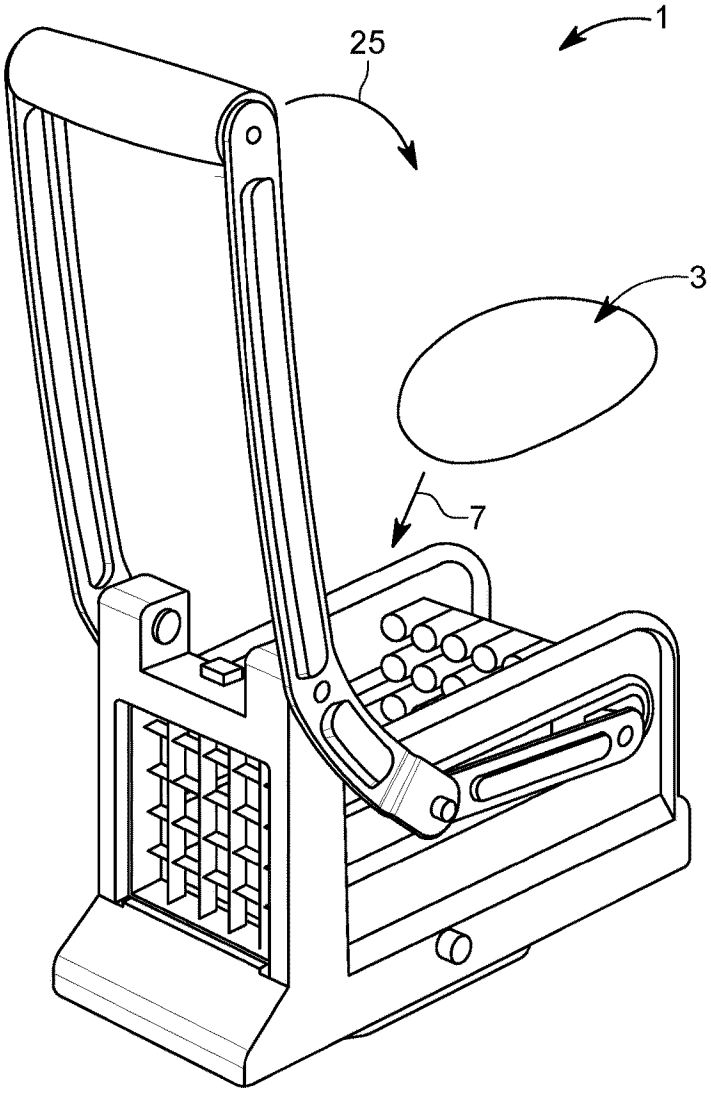
FIG. 5 is another perspective view of what is shown in FIG. 4, the removable cutting cartridge of the main cutting assembly being now shown inserted into the corresponding compartment of the base frame, and the cutting device being shown with a sample potato prior to insertion into the main receiving area of the base frame of the cutting device.
Figure 4:
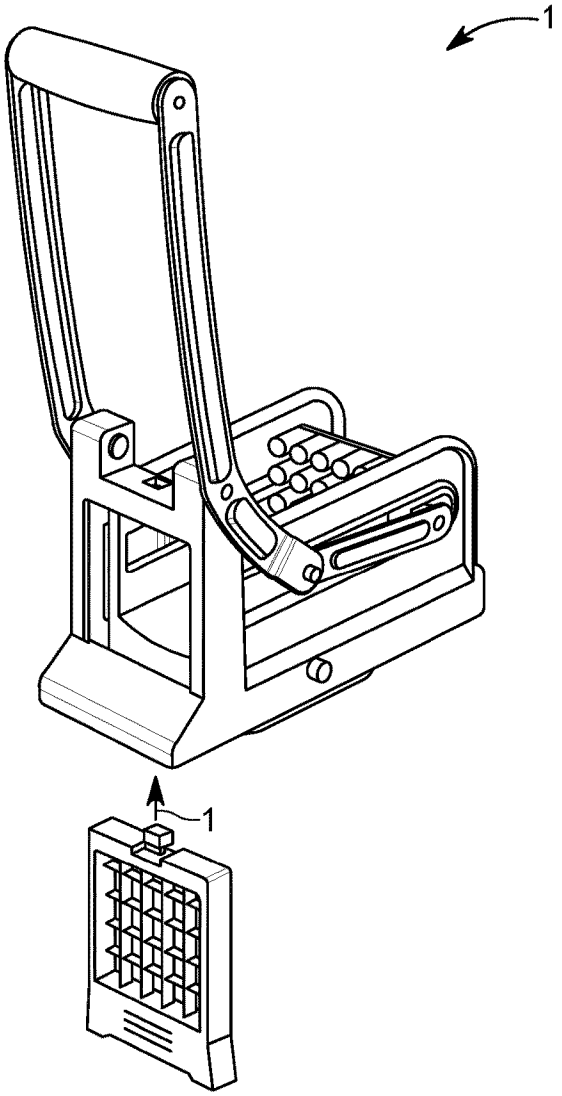
FIG. 4 is another perspective view of the cutting device shown in FIG. 1, the removable cutting cartridge of the main cutting assembly being shown in an exploded relationship with respect to the bottom opening of the base frame of the cutting device, and the at least one handle being shown in a first configuration.
Figure 6:
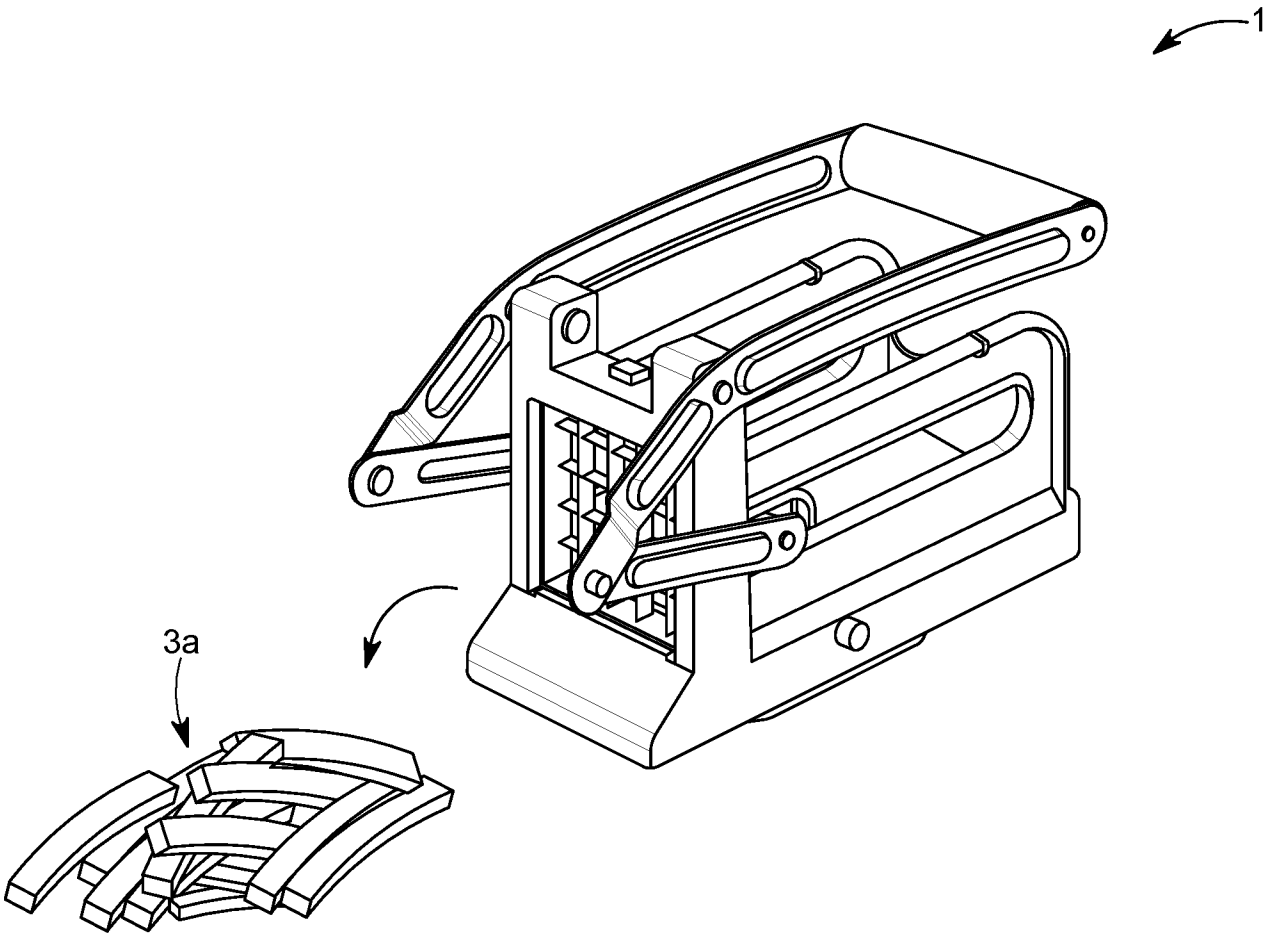
FIG. 6 is another perspective view of what is shown in FIG. 5, the cutting device being now shown with the sample potato having been inserted into the main receiving area disposed about the base frame, and with the at least one handle having been operated into a second configuration in order to push and cut the sample potato into fries via the main cutting interface of the main cutting assembly, according to a possible embodiment of the present invention.
Figure 8:
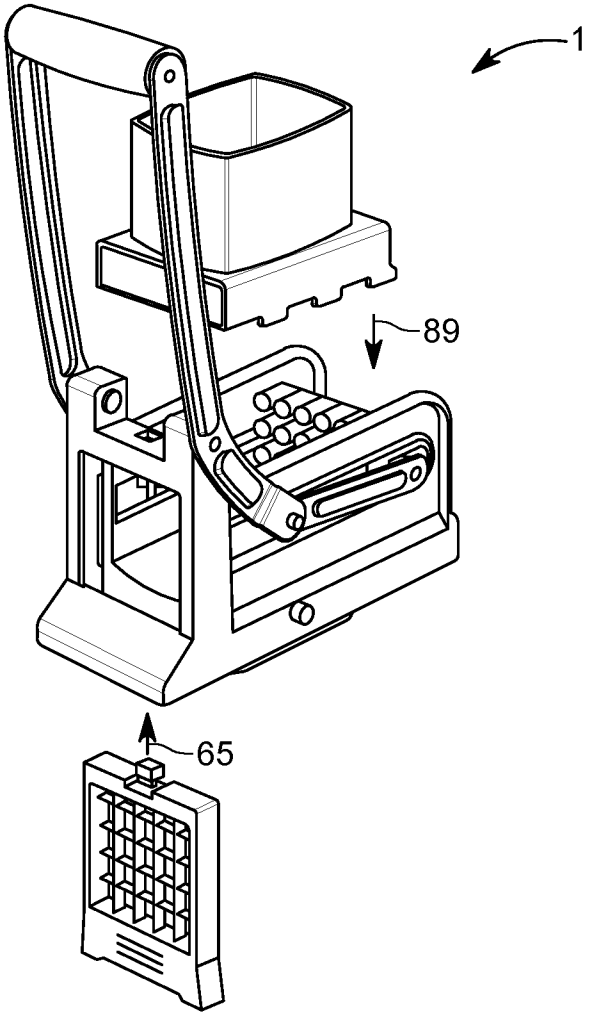
FIG. 8 is another perspective view of what is shown in FIG. 4, the cutting device being now shown with the removable cutting cartridge and corresponding housing component of FIG. 7 shown in an assembled configuration, and being further shown in an exploded relationship with respect to a top portion of the base frame of the cutting device, according to a possible embodiment of the present invention.
Figure 7:
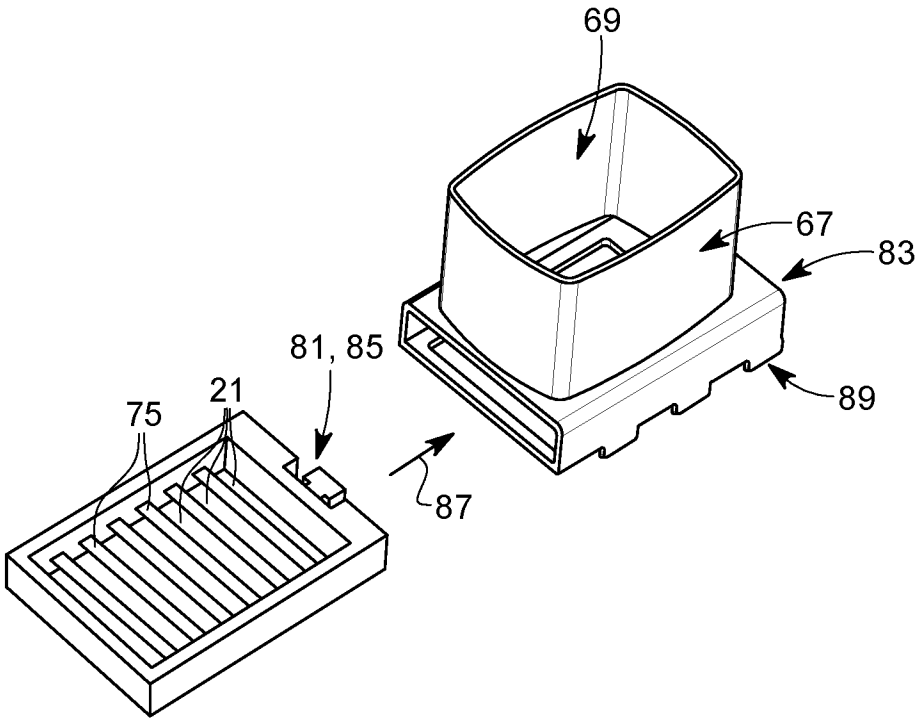
FIG. 7 a top perspective view of a removable cutting cartridge and corresponding housing component of the preliminary cutting assembly being shown in an exploded relationship with respect to each other according to a possible embodiment of the present invention.
Figure 10:
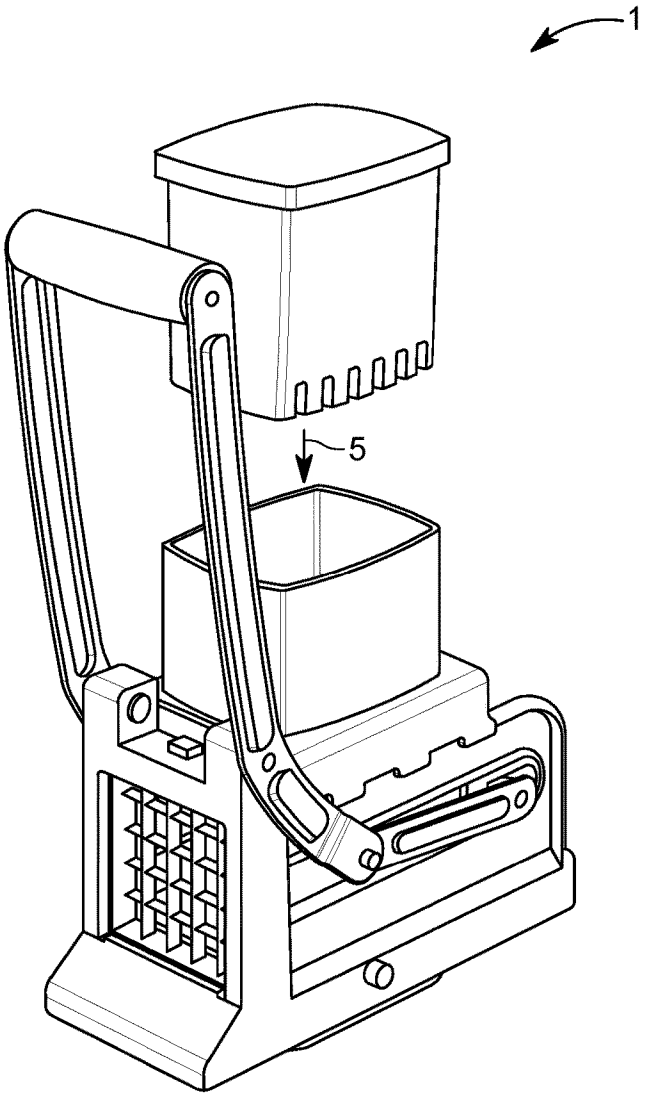
FIG. 10 is another perspective view of what is shown in FIG. 9, the cutting device being now shown with the pushing component in an exploded relationship with respect to the housing component of the preliminary cutting assembly, and with the sample potato being contained inside the cavity of the housing component.
Figure 9:
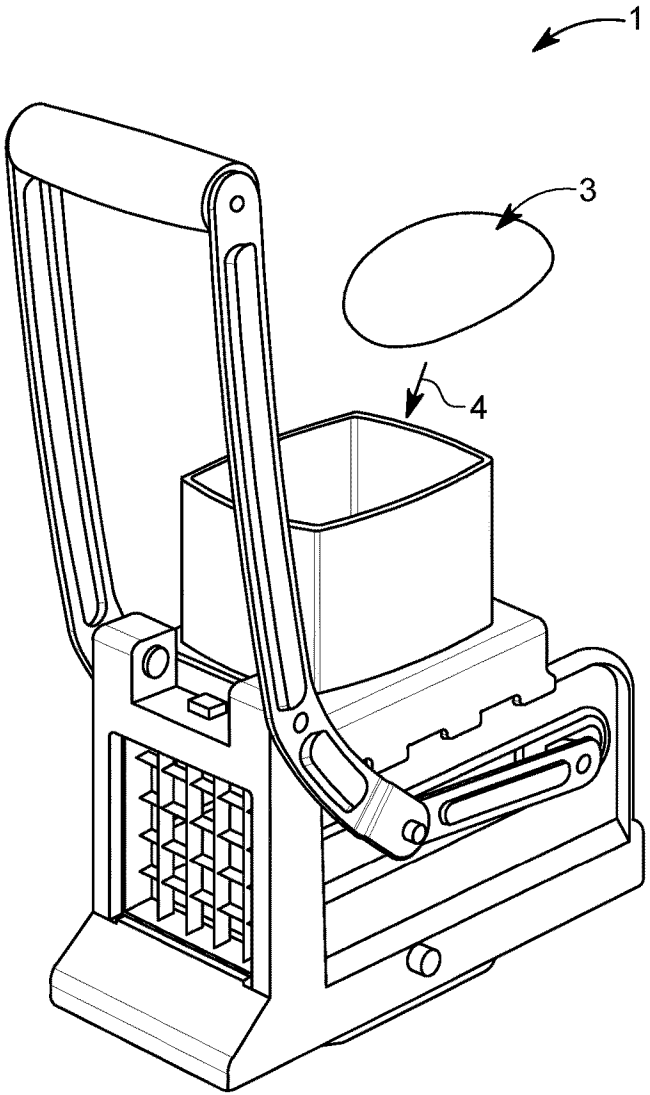
FIG. 9 is another perspective view of what is shown in FIG. 8, the cutting device being now shown with a sample potato prior to insertion into the housing component of the preliminary cutting assembly being mounted onto the top portion of the base frame, and with the removable cutting cartridge of the main cutting assembly being now shown inserted into the corresponding compartment of the base frame.
Figure 12:
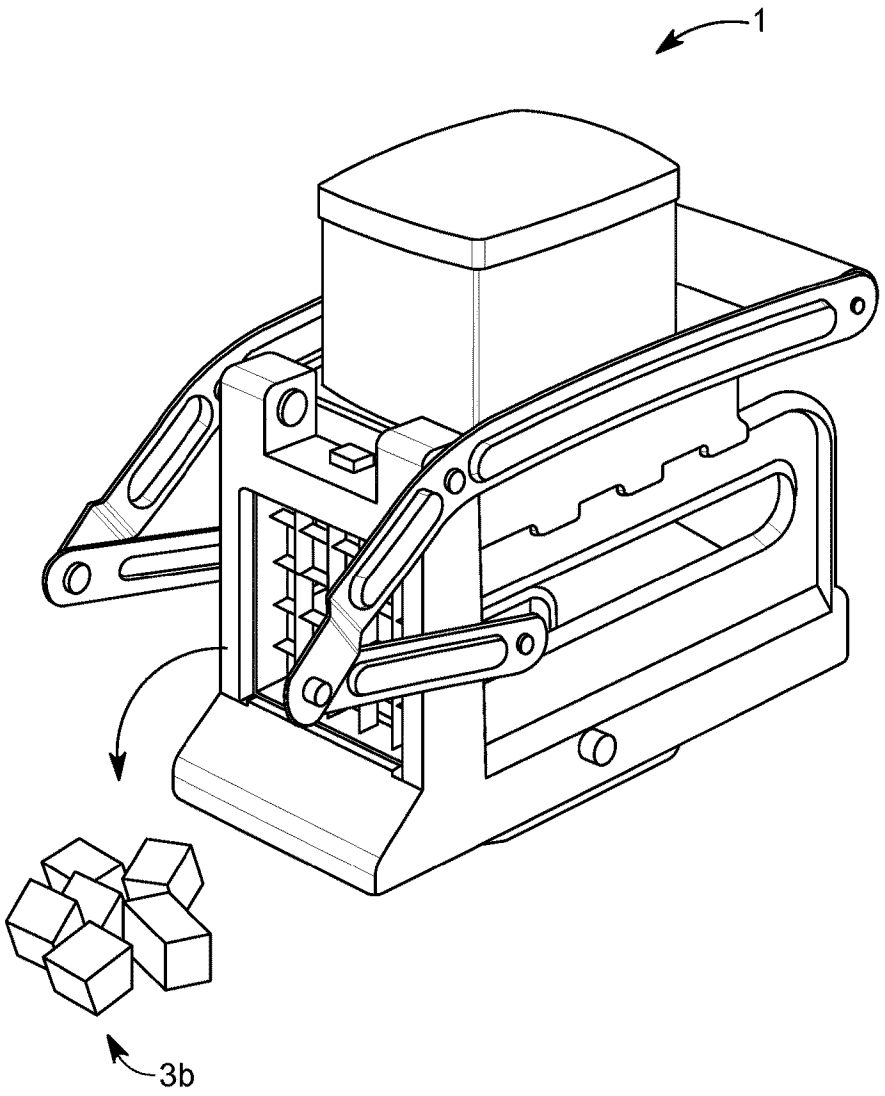
FIG. 12 is another perspective view of what is shown in FIG. 11, the cutting device being now shown with the at least one handle having been operated into a second configuration in order to push and cut the potato slices obtained from the preliminary cutting assembly into cubes via the main cutting interface of the main cutting assembly, according to a possible embodiment of the present invention.
Figure 11:
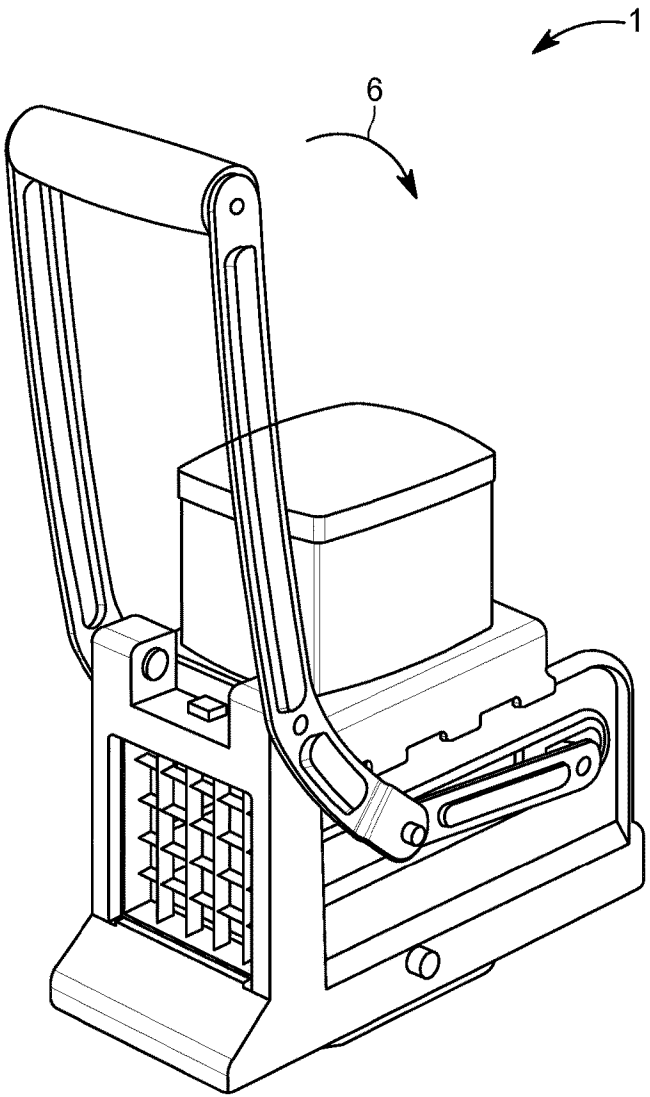
FIG. 11 is another perspective view of what is shown in FIG. 10, the cutting device being now shown with the pushing component being fully inserted into the housing component of the preliminary cutting assembly in order to push and cut the sample potato into slices via the preliminary cutting interface of the preliminary cutting assembly, according to a possible embodiment of the present invention.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for use with vegetables such as potatoes and the like, for cutting, slicing and/or cubing, it may be used with other objects and/or in other types of applications, as apparent to a person skilled in the art. For this reason, expressions such as "vegetable", "potato", "cutting", "slicing", "cubing", etc., used herein should not be taken so as to limit the scope of the present invention and include all other kinds of objects and/or applications with which the present invention could be used and may be useful. For example, the present cutting device could also be used with and/or for various other edible products (ex. "fruits", "meat" products such as ham, "cheeses", etc.) for instance, as well as various "non-edible" products, as can be easily understood by a person skilled in the art.

Moreover, in the context of the present invention, the expressions "cutting device", "cutter", "cuber", "slicer", "processor", "assembly", "system", "device", "apparatus", "product", "unit", "equipment", "tool", "method" and "kit", as well as any other equivalent expression(s) and/or compound word(s) thereof known in the art will be used interchangeably, as apparent to a person skilled in the art. This applies also for any other mutually equivalent expressions, such as, for example: a) "cutting"; "cubing", "slicing", "processing", "transforming", etc.; b) "pieces", "cuts", "cubes", "slices", "chunks", etc.; c) "stroke", "travel", "range", "motion", etc.; d) "distance", "position", "location", etc.; e) "hole", "orifice", "passage", "channel", "conduit", "path", "flow", etc.; f) "fastening", "securing", "locking", "restraining", "affixing", "holding", "adjusting", etc.; as well as for any other mutually equivalent expressions, pertaining to the aforementioned expressions and/or to any other structural and/or functional aspects of the present invention, as also apparent to a person skilled in the art. Also, in the context of the present description, expressions such as "can", "may", "might", "will", "could", "should", "would", etc., may also be used interchangeably, whenever appropriate, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully-assembled and fully-operational cutting device.

Moreover, components of the present system(s) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiments of the present invention as illustrated in the accompanying drawings comprise various components, and although the preferred embodiments of the present cutting device and corresponding portion(s)/part(s)/component(s) as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the present cutting device and corresponding portion(s)/part(s)/component(s) according to the present invention, as will be briefly explained herein and as can be easily inferred herefrom by a person skilled in the art, without departing from the scope of the present invention.

Broadly described, and as better exemplified in the accompanying drawings, the present invention relates to a cutting device capable of cutting (ex. slicing, cubing, etc.) edible products (ex. vegetables, fruits, ham, cheese, etc.), in a simpler, easier, faster, more accurate, more effective, more functional, more reliable and/or more versatile manner than what is possible with other conventional devices.

List of Numerical References for Some of the Corresponding Possible Components Illustrated in the Accompanying Drawings:

1. cutting device
3. edible product (to be cut)
3*a*. pieces (of edible product having gone through one cutting assembly)
3*b*. pieces (of edible product having gone through both cutting assemblies)
5. base frame
7. main receiving area (of base frame)
9. main pushing assembly
11. travel distance (within main receiving area of base frame)
13. main cutting assembly
15. holes (of main cutting assembly/interface)
17. main cutting interface
19. preliminary cutting assembly
21. holes (of preliminary cutting assembly/interface)
23. preliminary cutting interface
25. handle
27. pusher plate
29. linkage mechanism
31. pivot component (of linkage mechanism)
33. first link (of linkage mechanism)
33*a*. straight portion (of first link)
33*b*. curved portion (of second link)
35. second link (of linkage mechanism)
37. supporting component (of base frame for pivot component)
39. slot
41. side wall (of base frame)
43. sliding component (for second extremity of second link)
45. reinforcement (for link)
47. plate holding component
51. pushing finger (of pusher plate)
53. cutting blade (of main cutting assembly/interface)
55. removable cutting cartridge (of main cutting assembly/interface)
57. compartment (for removable cutting cartridge)
59. clipping mechanism (for main cutting assembly/interface)
61. receiving portion (of base frame)
63. protruding portion (of clipping mechanism)
65. bottom opening (of base frame)
67. housing component (of preliminary cutting assembly/interface)
69. cavity (of housing component)
71. pushing component (of preliminary cutting assembly/interface)
73. gripping fingers (of pushing component)
75. cutting blade (of preliminary cutting assembly/interface)
77. removable cutting cartridge (of preliminary cutting assembly/interface)
79. slit (for removable cutting cartridge)
81. clipping mechanism (for preliminary cutting assembly/interface)
83. receiving portion (of housing component)
85. protruding portion (of clipping mechanism)
87. side opening (of housing component)
89. mounting assembly
89*a*. male component (of mounting assembly)
89*b*. female component (of mounting assembly)
91. notch
93. non-slip suction base The present position-relative cutting device (1) may come in the form of a cutting device (1) including one and/or several of the following possible components and features (and/or different possible combination(s) and/or permutation(s) thereof):

Indeed, according to one possible embodiment, and as can be easily understood when referring to the accompanying drawings, there is provided a cutting device (1) for cutting an edible product (3) into several pieces. The cutting device (1) comprises a base frame (5). The cutting device (1) also comprises a main receiving area (7) disposed about the base frame (5) for receiving therein the edible product (3) to be cut. The cutting device (1) also comprises a main pushing assembly (9) being positioned, shaped and sized about the base frame (5) for selectively pushing the edible product (3) to be cut along a given travel distance (11) within the main receiving area (7) (ex. via a manual operation of the main pushing assembly (9), although other alternative ways of driving the main pushing assembly (9) are also possible, as can be easily understood by a person skilled in the art). The cutting device (1) also comprises a main cutting assembly (13) disposed about the base frame (5), opposite to the main pushing assembly (9), for receiving and cutting the edible product (3) pushed by the main pushing assembly (9), into a series of main cuts, via an array of holes (15) provided by a main cutting interface (17) of the main cutting assembly (13). The cutting device (1) also comprises a preliminary cutting assembly (19) removably mountable about the base frame (5) for first receiving and cutting the edible product (3) into a series of preliminary cuts (if so desired), via an array of holes (21) provided by a preliminary cutting interface (23) of the preliminary cutting assembly (19), prior to insertion of the edible product (3) into the main receiving area (7), wherein the edible product (3) is ultimately cut into a series of pieces resulting from the passage of the edible product (3) through at least one of said main and preliminary cutting interfaces (17,23) of the two different cutting assemblies (13,19) of the cutting device (1).

According to a possible embodiment, the base frame (5) is an elongated base frame (5), and the main receiving area (7) is an elongated main receiving area (7).

As can be easily understood when referring to the accompanying drawings, the main pushing assembly (9) may include at least one handle (25) and at least one pusher plate (27), with the at least one pusher plate (27) being operatively connected to the at least one handle (25) via at least one linkage mechanism (29), and the at least one pusher plate (27) being further configured for travelling along the main receiving area (7) via a manual operation of the at least one handle (25), for example.

According to a possible embodiment, the at least one linkage mechanism (29) may include at least one component (31) being pivotably mounted about the base frame (5) of the cutting device (1), and more particularly, the at least one linkage mechanism (29) may include first and second links (33,35) each having first and second extremities, the first link (33) being pivotably mounted about a corresponding supporting component (37) of the base frame (5) of the cutting device (1), with a first extremity of the first link (33) being operatively connected to the at least one handle (25), and a second extremity of the first link (33) being pivotably connected to a first extremity of the second link (35), and a second extremity of the second link (35) being operatively connected to the main pushing assembly (9), for example.

As can be easily understood when referring to the accompanying drawings, the second extremity of the second link (35) may be positioned, shaped and sized to travel along a corresponding slot (39) provided about a side wall (41) of the base frame (5) of the cutting device (1), for example.

According to a possible embodiment, the second extremity of the second link (35) is operatively connected to a sliding component (43) configured for travelling along said corresponding slot (39), and the second extremity of the second link (35) is operatively connected to the main pushing assembly (9), so that a manual operation of said main pushing assembly (9) via the at least one handle (25) forces the at least one pusher plate (27) to travel along the main receiving area (7) and to push the edible product (3) to be cut into and through corresponding holes (15) of the main cutting interface (17) of the main cutting assembly (13).

Optionally, the first link (33) of the at least one linkage mechanism (29) may include a substantially straight portion (33*a*) and a substantially curved portion (33*b*), and the second link (35) of the at least one linkage mechanism (29) may be substantially straight, for example, so as to provide the main pushing assembly (9) with a lever effect upon manual operation of the at least one handle (25) between opposite operating configurations.

At least one of the links (33,35) of the at least one linkage mechanism (29) may be provided with a corresponding reinforcement (45), and according to a possible embodiment, each link (33,35) of the at least one linkage mechanism (29) is provided with a corresponding reinforcement (45).

As can be easily understood when referring to the accompanying drawings, the second extremity of the second link (35) can be operatively connected to a corresponding plate holding component (47) of the main pushing assembly (9), and the plate holding component (9) can be positioned, shaped and sized for receiving the at least one pusher plate (27) of the main pushing assembly (9).

According to a possible embodiment, the plate holding component (47) comprises a locking mechanism for selectively locking the at least one pusher plate (27) of the main pushing assembly (9) in place with respect to the plate holding component (47).

As can be easily understood when referring to the accompanying drawings, the locking mechanism can be configured so that locking in place of the at least one pusher plate (27) of the main pushing assembly (9) with respect to the plate holding component (47) is done via a rotation of the at least one pusher plate (27) with respect to said plate holding component (47), for example.

According to a possible embodiment, the at least one linkage mechanism (29) includes a pair of first and second linkage mechanisms (29) each being operatively connected to a single and common handle (25), and being further operatively connected to a single and common pusher plate (27) of the main pushing assembly (9), and the at least one handle (25) may be substantially cylindrical, and may also be pivotably connected to the first and second linkage mechanisms (29), for example.

As can be easily understood when referring to the accompanying drawings, the at least one pusher plate (27) can be complementary in shape to the main cutting interface (17) of the main cutting assembly (13), in order to push the edible product (3) to be cut into and through corresponding holes (15) of the main cutting assembly (13).

According to a possible embodiment, the at least one pusher plate (27) comprises pushing fingers (51) being shaped and sized for extending through said corresponding holes (15) of the main cutting assembly (13), and the first and second linkage mechanisms (29) are displaceable along opposite side planes of the cutting device (1).

As can be easily understood when referring to the accompanying drawings, the at least one handle (25) can be operable between first and second configurations, wherein in the first configuration, the at least one handle (25) is raised with respect to the base frame (5) and the main pushing assembly (9) is drawn away from the main cutting interface (17) of the main cutting assembly (13), and wherein in the second configuration, the at least one handle (25) is drawn against the base frame (5) and the main pushing assembly (9) is pushed against the main cutting interface (17) of the main cutting assembly (13).

According to a possible embodiment, the array of holes (15) of the main cutting interface (17) of the main cutting assembly (13) is defined by a series of cutting blades (53) operatively connected to one another, for example.

As can be easily understood when referring to the accompanying drawings, the main cutting interface (17) of the main cutting assembly (13) can be provided by a removable cutting cartridge (55) being selectively insertable into a corresponding compartment (57) of the base frame (5).

According to a possible embodiment, the array of holes (15) of the main cutting interface (17) of the main cutting assembly (13) are disposed about and provided by the removable cutting cartridge (55), and each hole (15) of the main cutting interface (17) of the main cutting assembly (13) can haven sides, n being an integer greater than 1. For example, in the case where n is equal to 1, each hole (15) of the main cutting assembly (13) can have a substantially elliptical cross-sectional profile and/or a substantially circular cross-sectional profile, for example. In the case where n is equal to 3, each hole (15) of the main cutting assembly (13) can have a substantially triangular cross-sectional profile. Similarly, in the case where n is equal to 4, each hole (15) of the main cutting assembly (13) can have a substantially paralepidid cross-sectional profile, a substantially rectangular cross-sectional profile, and/or a substantially square cross-sectional profile. Thus, and as can be easily understood, the holes (5) of the main cutting interface (17) of the main cutting assembly (13) may come in a series of different and/or varied cross-sectional profiles, depending on what the cutting device (1) is intended for, and the desired end results.

As can be easily understood when referring to the accompanying drawings, the removable cutting cartridge (55) may comprise an array of holes (15) having m rows by n columns, wherein m and n are both integers greater than 1, for a total of m×n holes (15), and according to a possible embodiment, m and n are equal to 5, and thus, the removable cutting cartridge (55) comprises an array of holes (15) having five columns by five rows, for a total of twenty-five holes (15), as exemplified in the figures. According to this particular embodiment, the holes (15) of the removable cutting cartridge (55) have a substantially square cross-sectional profile, for example.

As can be easily understood when referring to the accompanying drawings, the removable cutting cartridge (55) may include a clipping mechanism (59) operatively connectable to a corresponding receiving portion (61) of the base frame (5) for removably securing the removable cutting cartridge (55) in place about said base frame (5).

According to a possible embodiment, the clipping mechanism (61) may comprise a protruding portion (63) extendable beyond the receiving portion (61) of the base frame (5), in order to allow a user of the cutting device (1) to push onto said protruding portion (63), for removing the removable cutting cartridge (55) from the compartment (57) of the base frame (5).

According to the embodiment exemplified in the figures, the removable cutting cartridge (55) has a substantially rectangular profile, and the compartment (57) of the base frame (5) for receiving said removable cutting cartridge (55) has a corresponding substantially rectangular profile as well.

As can be easily understood when referring to the accompanying drawings, the removable cutting cartridge (55) can be removably insertable into the compartment (57) of the base frame (5) via a bottom opening (65) of said base frame (5).

According to a possible embodiment, the preliminary cutting assembly (19) is removably mountable about a top portion of the base frame (5), and the preliminary cutting assembly (19) of the cutting device (1) includes a housing component (67) having a cavity (69) being positioned, shaped and sized for receiving therein the edible product (3) to be cut via the preliminary cutting interface (23), prior to insertion of the edible product (3) into the main receiving area (7) of the base frame (5).

As can be easily understood when referring to the accompanying drawings, the preliminary cutting assembly (19) of the cutting device (1) may include a pushing component (71) for selectively pushing the edible product (3) into and along the cavity (69) of the housing component (67), and in turn, into and through corresponding holes (21) of the preliminary cutting interface (23) of the preliminary cutting assembly (19).

According to a possible embodiment, the pushing component (71) may comprise gripping fingers (73) being shaped and sized for pushing and gripping into the edible product (3) to be cut via the preliminary cutting interface (23) of the preliminary cutting assembly (19).

Similarly to what was described earlier, the array of holes (21) of the preliminary cutting interface (23) of the preliminary cutting assembly (19) may be defined by a series of cutting blades (75) operatively connected to one another, for example.

According to a possible embodiment, the preliminary cutting interface (23) of the preliminary cutting assembly (19) is provided by a removable cutting cartridge (77) being selectively insertable into a corresponding slit (79) of the housing component (67) of the preliminary cutting assembly (19) of the cutting device (1). The slit (79) of the housing component (67) of the preliminary cutting assembly (19) may be disposed traversal to a direction of travel of the pushing component (71), for example.

As can be easily understood when referring to the accompanying drawings, the array of holes (21) of the preliminary cutting assembly (19) may be disposed about and provided by the removable cutting cartridge (77) of the preliminary cutting assembly (19), with each hole (21) of the preliminary cutting assembly (19) has n sides, n being an integer greater than 1, for example. Indeed, and also similarly to what was discussed earlier, in the case where n is equal to 1, each hole (21) of the preliminary cutting assembly (19) can have a substantially elliptical cross-sectional profile and/or a substantially circular cross-section profile. In the case where n is equal to 3, each hole (21) of the preliminary cutting assembly (19) can have a substantially triangular cross-sectional profile. In the case where n is equal to 4, each hole (21) of the preliminary cutting assembly (19) can have a substantially paralepidid cross-sectional profile, a substantially rectangular cross-sectional profile, and/or a substantially square cross-sectional profile, for example. Thus, and as can be easily understood, the holes (21) of the preliminary cutting assembly (19) may come in a series of different and/or varied cross-sectional profiles, depending on what the cutting device (1) is intended for, and the desired end results.

As can be easily understood when referring to the accompanying drawings, the removable cutting cartridge (77) of the preliminary cutting assembly (19) may comprise an array of holes (21) having m rows by n columns, wherein m and n are both integers greater than 1, for a total of m×n holes (21), and according to a possible embodiment, m is equal to 1 and n are equal to 7, and thus, the removable cutting cartridge (77) of the preliminary cutting assembly (19) comprises an array of holes (21) having one row by seven columns, for a total of seven holes (21), as exemplified in the figures.

According to this particular embodiment, the holes (21) of the removable cutting cartridge (77) of the preliminary cutting assembly (19) are of substantially rectangular cross-sectional profile, for example.

As can be easily understood when referring to the accompanying drawings, the removable cutting cartridge (77) of the preliminary cutting assembly (19) may include a clipping mechanism (81) operatively connectable to a corresponding receiving portion (83) of the housing component (67) for removably securing the removable cutting cartridge (77) of the preliminary cutting assembly (19) in place about said housing component (67).

According to a possible embodiment, the clipping mechanism (81) of the removable cutting cartridge (77) of the preliminary cutting assembly (19) may comprise a protruding portion (85) extendable beyond the receiving portion (83) of the housing component (67), in order to allow a user of the cutting device (1) to push onto said protruding portion (85), for removing the removable cutting cartridge (77) from the slit (79) of the housing component (67).

According to the embodiment exemplified in the figures, the removable cutting cartridge (77) of the preliminary cutting assembly (19) has a substantially rectangular profile, and the slit (79) of the housing component (67) for receiving said removable cutting cartridge (77) has a corresponding substantially rectangular profile as well, for example.

As can be easily understood when referring to the accompanying drawings, the removable cutting cartridge (77) of the preliminary cutting assembly (19) can be removably insertable into the slit (79) of the housing component (67) via a side opening (87) of said housing component (67), for instance.

The housing component (67) of the preliminary cutting assembly (19) may also comprise a mounting assembly (89) for removably mounting the housing component (67) of the preliminary cutting assembly (19) onto a top portion of the base frame (5), for example.

According to a possible embodiment, the mounting assembly (89) may comprise at least one male component (89*a*) insertable into at least one corresponding female component (89*b*), with the at least one male component (89*a*) being provided about the top portion of the base frame (5), and with the at least one corresponding female component (89*b*) being provided about the housing component (67) of the preliminary cutting assembly (19), for example.

As can be easily understood when referring to the accompanying drawings, the base frame (5) may comprise first and second series of male components (89*a*) provided respectively about first and second side walls (41) of the base frame (5), and the housing component (67) of the preliminary cutting assembly (19) may comprise a corresponding pair of first and second series of female components (89*b*) being disposed about opposite sides of the housing component (67).

According to a possible embodiment, at least one given series of female components (89*b*) of the housing component (67) are positioned, shaped and sized to be inserted into corresponding notches (91) defined by a corresponding series of male components (89*a*), and to be slid into said corresponding series of male components (89*a*) by sliding the housing component (67) along a given direction of travel of the base frame (5), as can be easily understood when referring to the accompanying drawings.

According to another possible embodiment, the base frame (5) of the cutting device (1) comprises a non-slip suction base (93), and/or any other type of component and/or feature in order to securely maintain the cutting device (1) in place about a given work surface.

According to another aspect of the present invention, there is provided a kit with components for assembling a cutting device (1) such as the one described and/or illustrated in the present patent specification.

According to yet another aspect of the present invention, there is also provided a method for cutting an edible product (3) into several pieces, the method comprising the steps of: a) providing a cutting device (1) such as the one described and/or illustrated in the present patent specification; and b) passing the edible product (3) to be cut into a series of pieces through at least one of the main and preliminary cutting interfaces (17,23) of the cutting device (1). Step b) may comprise the step of passing the edible product (3) to be cut through both the main and preliminary cutting interfaces (17,23) of the cutting device (1).

Other possible aspect(s), object(s), embodiment(s), variant(s), and/or resulting advantage(s) of the cutting device (1), all being preferred and/or optional, are briefly explained hereinbelow, and can be easily understood and/or inferred from the accompanying drawings, as well.

Indeed, as may now be better appreciated, the present cutting device (1) is advantageous in that, thanks to its innovative design, and corresponding innovative components and features, it can be used for various applications, and in order to obtain various end results. For example, the cutting device (1) could be used as a "fry cutter assembly" and in order to operate such an assembly, one could carry out the following steps, for example:

a) lift the handle so that it stands vertically;

b) insert the pusher plate to the end of the pusher plate holder;

c) lock it by turning it counterclockwise, for example; and d) insert the square blades cartridge (for example, the one with the grid pattern) into the compartment until it stops (making sure that the blade cartridge is held by the plastic frame, given the fact that the blades may be sharp); and e) toggle the lever to secure the unit (ideally, making sure that unit is placed on a clean, flat and non-textured surface).

The present cutting device (1), by virtue of its innovative design, and corresponding innovative components and features, could also be used as a "cuber assembly", in which case, when using such an assembly, one could carry out the following steps, for example:

a) do the above-mentioned fry cutter assembly;

b) insert the horizontal blades cartridge (for example, the one with the straight pattern) into the pusher housing until it stops (making sure that the blade cartridge is held by the plastic frame, given the fact that the blades may be sharp);

c) assemble the housing pusher onto the fry cutter and secure it by sliding it forward in the appropriate direction;

d) insert the pusher into the pusher housing; and e) toggle the lever to secure the unit (ideally, making sure that the unit is placed on a clean, flat and non-textured surface).

In order to use the present cutting device as a "fry cutter", the following steps could be carried out in accordance with a possible embodiment:

a) lift the handle so that it stands vertically;

b) insert the food into the cavity (between the pusher plate and the square blades, and ideally, making sure that the food does not exceed maximum height and width of the square blades—indeed, it might be necessary to trim the edible product, if need may be);

c) lower the handle; and d) repeat steps 1 to 3 as many times as necessary.

In order to use the present cutting device as a "cuber", the following steps could be carried out in accordance with a possible embodiment:

a) lift the handle so that it stands vertically;

b) remove the pusher and insert the food inside the cavity (and ideally, making sure that the food does not exceed maximum height, width and height of the cavity—indeed, it might be necessary to trim the edible product, if need may be);

c) place hands on the pusher and push until the food is completely processed;

d) place one hand on the handle and push it down completely; and e) repeat steps 1 to 4 as many times as necessary.

The present cutting device (1) is designed so that components and/or parts thereof may be disassembled conveniently, and so that they may be washed in warm soapy water, for example.

As may now be better appreciated also, the present cutting device (1) is further advantageous in that it enables to cut and/or cube edible products in a more efficient, more precise, more accurate, more reliable, more adjustable, more versatile, more adaptable, more ergonomic and/or more desirable manner, than what is possible with conventional devices.

The present cutting device (1) and corresponding parts are preferably made of substantially rigid materials, such as metallic materials, hardened polymers, composite materials, polymeric materials, and/or the like, so as to ensure a proper operation thereof depending on the particular applications for which the cutting device (1) is intended and the different parameters (forces, moments, etc.) in cause, as apparent to a person skilled in the art.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claims and as apparent to a person skilled in the art.

The invention claimed is:

1. A cutting device (1) for cutting an edible product (3) into several pieces, the cutting device (1) comprising:

a base frame (5);

a main receiving area (7) disposed about the base frame (5) and used for receiving therein the edible product (3) to be cut;

a main pushing assembly (9) being positioned, shaped and sized about the base frame (5) for selectively pushing the edible product (3) to be cut along a given travel distance (11) within the main receiving area (7), the main pushing assembly (9) including at least one handle (25) and at least one pusher plate (27), the at least one pusher plate (27) being operatively connected to the at least one handle (25) via at least one linkage mechanism (29), the at least one pusher plate (27) being further configured for travelling along the main receiving area (7) via a manual operation of the at least one handle (25);

a main cutting assembly (13) disposed about the base frame (5), opposite to the main pushing assembly (9), for receiving and cutting the edible product (3) pushed by the main pushing assembly (9) into a series of main cuts via an array of holes (15) provided by a main cutting interface (17) of the main cutting assembly (13);

a preliminary cutting assembly (19) removably mountable about the base frame (5) for first receiving and cutting the edible product (3) into a series of preliminary cuts, via an array of holes (21) provided by a preliminary cutting interface (23) of the preliminary cutting assembly (19), prior to insertion of the edible product (3) into the main receiving area (7), wherein the edible product (3) is ultimately cut into a series of pieces resulting from passage of the edible product (3) through at least one of said main cutting interface (17) and said preliminary cutting interface (23) of the cutting device (1);

wherein the preliminary cutting assembly (19) is removably mountable about a top portion of the base frame (5);

wherein the preliminary cutting assembly (19) of the cutting device (1) includes a housing component (67) having a cavity (69) being positioned, shaped and sized for receiving in the housing component (67) the edible product (3) to be cut via the preliminary cutting interface (23), prior to insertion of the edible product (3) into the main receiving area (7) of the base frame (5);

wherein the preliminary cutting assembly (19) of the cutting device (1) includes a pushing component (71) for selectively pushing the edible product (3) into and along the cavity (69) of the housing component (67), and in turn, into and through at least some of the holes (21) of the preliminary cutting interface (23) of the preliminary cutting assembly (19);

wherein the pushing component (71) comprises gripping fingers (73) being shaped and sized for pushing and gripping the edible product (3) to be cut via the preliminary cutting interface (23) of the preliminary cuffing assembly (19);

wherein the array of holes (21) of the preliminary cutting interface (23) of the preliminary cutting assembly (19) is defined by a series of cutting blades (75) operatively connected to one another;

wherein the preliminary cutting interface (23) of the preliminary cutting assembly (19) is provided by a removable cutting cartridge (77) being selectively insertable into a corresponding slit (79) of the housing component (67) of the preliminary cutting assembly (19) of the cutting device (1);

wherein the slit (79) of the housing component (67) of the preliminary cutting assembly (19) is disposed transverse to a direction of travel of the pushing component (71), and wherein the slit (49) is enclosed on four sides;

wherein the array of holes (21) of the preliminary cutting interface (23) are disposed about and provided by the removable cutting cartridge (77) of the preliminary cutting assembly (19); and wherein the removable cutting cartridge (77) comprises the array of holes (21) of the preliminary cutting interface (23), and wherein said holes (21) of the preliminary cutting interface (23) are disposed along at least one row and at least one column of the removable cutting cartridge (77).

2. A cutting device (1) according to claim 1, wherein the base frame (5) is an elongated base frame (5), and wherein the main receiving area (7) is an elongated main receiving area (7).

3. A cutting device (1) according to claim 1, wherein the base frame (5) comprises first and second series of male components (89*a*) provided respectively about first and second side walls (41) of the base frame (5), and wherein the housing component (67) of the preliminary cutting assembly (19) comprises a corresponding pair of first and second series of female components (89*b*) being disposed about opposite sides of the housing component (67); and wherein the female components (89*b*) of the housing component (67) are positioned, shaped and sized to be inserted into corresponding notches (91) defined by the male components (89*a*), and to be slid into said male components (89*a*) by sliding the housing component (67) along a given direction of travel of the base frame (5).

4. A cutting device (1) according to claim 1, wherein the at least one linkage mechanism (29) includes at least one component (31) being pivotably mounted about the base frame (5) of the cutting device (1).

5. A cutting device (1) according to claim 4, wherein the at least one linkage mechanism (29) includes first and second links (33,35), each of the first and second links having first and second extremities, the first link (33) being pivotably mounted about a corresponding supporting component (37) of the base frame (5) of the cutting device (1), with the first extremity of the first link (33) being operatively connected to the at least one handle (25), and the second extremity of the first link (33) being pivotably connected to the first extremity of the second link (35), and the second extremity of the second link (35) being operatively connected to the main pushing assembly (9);

wherein the second extremity of the second link (35) is positioned, shaped and sized to travel along a corresponding slot (39) provided about a side wall (41) of the base frame (5) of the cutting device (1);

wherein the second extremity of the second link (35) is operatively connected to a sliding component (43) configured for travelling along said corresponding slot (39), and wherein the second extremity of the second link (35) is operatively connected to the main pushing assembly (9), so that a movement of said main pushing assembly (9) via the at least one handle (25) forces the at least one pusher plate (27) to travel along the main receiving area (7) and to push the edible product (3) to be cut into and through at least some of the holes (15) of the main cutting interface (17) of the main cutting assembly (13);

wherein the first link (33) of the at least one linkage mechanism (29) includes a first portion (33*a*) and a second portion (33*b*), and wherein the second link (35) of the at least one linkage mechanism (29) is shaped, so as to provide the main pushing assembly (9) with a lever effect when the at least one handle (25) is operated between opposite operating configurations;

wherein at least one of the links (33,35) of the at least one linkage mechanism (29) is provided with a corresponding reinforcement (45);

wherein the second extremity of the second link (35) is operatively connected to a corresponding plate holding component (47) of the main pushing assembly (9); and wherein the plate holding component (47) is positioned, shaped and sized for receiving the at least one pusher plate (27) of the main pushing assembly (9).

6. A cutting device (1) according to claim 1, wherein the base frame (5) of the cutting device (1) comprises a non-slip suction base (93).

7. A cutting device (1) according to claim 1, wherein the at least one linkage mechanism (29) includes first and second linkage mechanisms (29) each being operatively connected to the at least one handle (25), and being further operatively connected to the at least one pusher plate (27) of the main pushing assembly (9);

wherein the at least one handle (25) is cylindrical;

wherein the at least one handle (25) is pivotably connected to a portion of each of the first and second linkage mechanisms (29);

wherein the at least one pusher plate (27) is complementary in shape to the main cutting interface (17) of the main cutting assembly (13), in order to push the edible product (3) to be cut into and through at least some of the holes (15) of the main cutting assembly (13);

wherein the at least one pusher plate (27) comprises pushing fingers (51) being shaped and sized for extending through the holes (15) of the main cutting assembly (13);

wherein the first and second linkage mechanisms (29) are displaceable along opposite side planes of the cutting device (1); and wherein the at least one handle (25) is operable between first and second configurations, wherein in the first configuration, the at least one handle (25) is raised with respect to the base frame (5) and the main pushing assembly (9) is drawn away from the main cutting interface (17) of the main cutting assembly (13), and wherein in the second configuration, the at least one handle (25) is drawn against the base frame (5) and the main pushing assembly (9) is pushed against the main cutting interface (17) of the main cutting assembly (13).

8. A cutting device (1) according to claim 1, wherein the array of holes (15) of the main cutting interface (17) of the main cutting assembly (13) is defined by a series of cutting blades (53) operatively connected to one another.

9. A cutting device (1) according to claim 8, wherein the main cutting interface (17) of the main cutting assembly (13) is provided by a removable cutting cartridge (55) being selectively insertable into a corresponding compartment (57) of the base frame (5);

wherein the array of holes (15) of the main cutting interface (17) of the main cutting assembly (13) are disposed about and provided by the removable cutting cartridge (55); and wherein the removable cutting cartridge (55) comprises the array of holes (15) of the main cutting interface (17), and wherein said holes (15) of the main cutting interface (17) are disposed along at least one row and at least one column of the removable cutting cartridge (55).

10. A cutting device (1) according to claim 9, wherein the removable cutting cartridge (55) includes a clipping mechanism (59) operatively connectable to a corresponding receiving portion (61) of the base frame (5) for removably securing the removable cutting cartridge (55) in place about said base frame (5); and wherein the clipping mechanism (61) comprises a protruding portion (63) extendable beyond the receiving portion (61) of the base frame (5) in order to allow a user of the cutting device (1) to push onto said protruding portion (63) for removing the removable cutting cartridge (55) from the compartment (57) of the base frame (5).

11. A cutting device (1) according to claim 9, wherein the removable cutting cartridge (55) has a rectangular profile, and wherein the compartment (57) of the base frame (5) for receiving said removable cutting cartridge (55) has a corresponding rectangular profile as well; and wherein the removable cutting cartridge (55) is removably insertable into the compartment (57) of the base frame (5) via a bottom opening (65) of said base frame (5).

12. A cutting device (1) according to claim 1, wherein the removable cutting cartridge (77) of the preliminary cutting assembly (19) has a rectangular profile, and wherein the slit (79) of the housing component (67) for receiving said removable cutting cartridge (77) has a corresponding rectangular profile as well;

wherein the removable cutting cartridge (77) of the preliminary cutting assembly (19) is removably insertable into the slit (79) of the housing component (67) via a side opening (87) of said housing component (67); and wherein the housing component (67) of the preliminary cutting assembly (19) comprises a mounting assembly (89) for removably mounting the housing component (67) of the preliminary cutting assembly (19) onto a top portion of the base frame (5), the mounting assembly (89) comprising at least one male component (89*a*) insertable into at least one corresponding female component (89*b*).

13. A cutting device (1) according to claim 12, wherein the at least one male component (89*a*) is provided about the top portion of the base frame (5), and wherein the at least one corresponding female component (89*b*) is provided about the housing component (67) of the preliminary cutting assembly (19).

14. A cutting device (1) for cutting an edible product (3) into several pieces, the cutting device (1) comprising:

a base frame (5);

a main receiving area (7) disposed about the base frame (5) and used for receiving the edible product (3) to be cut;

a main pushing assembly (9) being positioned, shaped and sized about the base frame (5) for selectively pushing the edible product (3) to be cut along a given travel distance (11) within the main receiving area (7), the main pushing assembly (9) including at least one handle (25) and at least one pusher plate (27), the at least one pusher plate (27) being operatively connected to the at least one handle (25) via at least one linkage mechanism (29), the at least one pusher plate (27) being further configured for travelling along the main receiving area (7) via a manual operation of the at least one handle (25);

a main cutting assembly (13) disposed about the base frame (5), opposite to the main pushing assembly (9), for receiving and cutting the edible product (3) pushed by the main pushing assembly (9) into a series of main cuts via an array of holes (15) provided by a main cutting interface (17) of the main cutting assembly (13);

a preliminary cutting assembly (19) removably mountable about the base frame (5) for first receiving and cutting the edible product (3) into a series of preliminary cuts, via an array of holes (21) provided by a preliminary cutting interface (23) of the preliminary cutting assembly (19), prior to insertion of the edible product (3) into the main receiving area (7), wherein the edible product (3) is ultimately cut into a series of pieces resulting from passage of the edible product (3) through at east one of said main cutting interface (17) and said preliminary cutting interface (23) of the cuffing device (1);

wherein the preliminary cutting assembly (19) is removably mountable about a top portion of the base frame (5);

wherein the preliminary cutting assembly (19) of the cutting device (1) includes a housing component (67) having a cavity (69) being positioned, shaped and sized for receiving in the housing component (67) the edible product (3) to be cut via the preliminary cutting interface (23), prior to insertion of the edible product (3) into the main receiving area (7) of the base frame (5);

wherein the preliminary cutting assembly (19) of the cutting device (1) includes a pushing component (71) for selectively pushing the edible product (3) into and along the cavity (69) of the housing component (67), and in turn, into and through at least some of the holes (21) of the preliminary cutting interface (23) of the preliminary cutting assembly (19);

wherein the pushing component (71) comprises gripping fingers (73) being shaped and sized for pushing and gripping the edible product (3) to be cut via the preliminary cutting interface (23) of the preliminary cuffing assembly (19);

wherein the array of holes (21) of the preliminary cutting interface (23) of the preliminary cutting assembly (19) is defined by a series of cutting blades (75) operatively connected to one another;

wherein the preliminary cutting interface (23) of the preliminary cutting assembly (19) is provided by a removable cutting cartridge (77) being selectively insertable into a corresponding slit (79) of the housing component (67) of the preliminary cutting assembly (19) of the cutting device (1);

wherein the slit (79) of the housing component (67) of the preliminary cutting assembly (19) is disposed transverse to a direction of travel of the pushing component (71);

wherein the array of holes (21) of the preliminary cutting interface (23) are disposed about and provided by the removable cutting cartridge (77) of the preliminary cutting assembly (19);

wherein the removable cutting cartridge (77) of the preliminary cutting assembly (19) has a rectangular profile, and wherein the slit (79) of the housing component (67) for receiving said removable cutting cartridge (77) has a corresponding rectangular profile as well;

wherein the removable cutting cartridge (77) of the preliminary cutting assembly (19) is removably insertable into the slit (79) of the housing component (67) via a side opening (87) of said housing component (67); and wherein the housing component (67) of the preliminary cutting assembly (19) comprises a mounting assembly (89) for removably mounting the housing component (67) of the preliminary cutting assembly (19) onto a top portion of the base frame (5), the mounting assembly (89) comprising at least one male component (89*a*) insertable into at least one corresponding female component (89*b*).

* * * * *